US005311938A

United States Patent [19]

Hendrickson et al.

[11] Patent Number: 5,311,938

[45] Date of Patent: May 17, 1994

[54] RETRIEVABLE PACKER FOR HIGH TEMPERATURE, HIGH PRESSURE SERVICE

[75] Inventors: James D. Hendrickson; Colby M. Ross, both of Carrollton; William D. Henderson, League City, all of Tex.

[73] Assignee: Halliburton Company, Houston, Tex.

[21] Appl. No.: 884,529

[22] Filed: May 15, 1992

[51] Int. Cl.[5] ..... E21B 33/128

[52] U.S. Cl. ..... 166/134; 166/182; 166/196

[58] Field of Search ..... 166/134, 138, 182, 196, 166/202, 123

[56] References Cited

U.S. PATENT DOCUMENTS

| | | | |
|---|---|---|---|
| 1,246,957 | 11/1917 | Lindsay . | |
| 1,336,738 | 4/1920 | Fletcher . | |
| 3,374,840 | 3/1968 | Current | 166/196 |
| 3,631,926 | 1/1972 | Young | 166/134 |
| 4,224,987 | 9/1980 | Allen | 166/120 |
| 4,457,369 | 7/1984 | Henderson | 166/125 |
| 4,809,989 | 3/1989 | Kernal | 277/30 |
| 4,834,175 | 5/1989 | Ross et al. | 166/120 |

*Primary Examiner*—Terry Lee Melius

*Attorney, Agent, or Firm*—Tracy W. Druce; Dennis T. Griggs

[57] ABSTRACT

In a retrievable packer adapted for service under high temperature and high pressure operating conditions, improved sealing is provided by a seal element prop surface which is radially offset with respect to the seal element support surface of the packer body mandrel. At least one seal element is supported on the elevated prop surface and is subjected to a radial squeeze in the set configuration, even though the lowermost outside seal element may be subject to longitudinal separation. The split level seal element support arrangement provides an annular pocket into which the seal elements can be retracted upon release and retrieval of the packer, thereby providing clearance for unobstructed retrieval. Upon release of the packer, a retainer collar is shifted away from a metal backup shoe, thereby providing an annular pocket into which the metal backup shoe is deflected, so that it does not obstruct the drift clearance as the packer is retrieved. The upper outside seal element is reinforced by a garter spring assembly having deformation resistant reinforcing material enclosed within a helical wound coil. Preloading of the seal element assembly is provided by a cover sleeve which releases when a predetermined amount of compression has been achieved. The controlled preloading of the seal elements assists movement of the elements from the lower O.D. of the packer mandrel to the upper O.D. of the prop surface, and the seal elements are forced to expand into the annulus uniformly for preventing the formation of uneven extrusion gaps.

21 Claims, 7 Drawing Sheets

SET

RELEASE

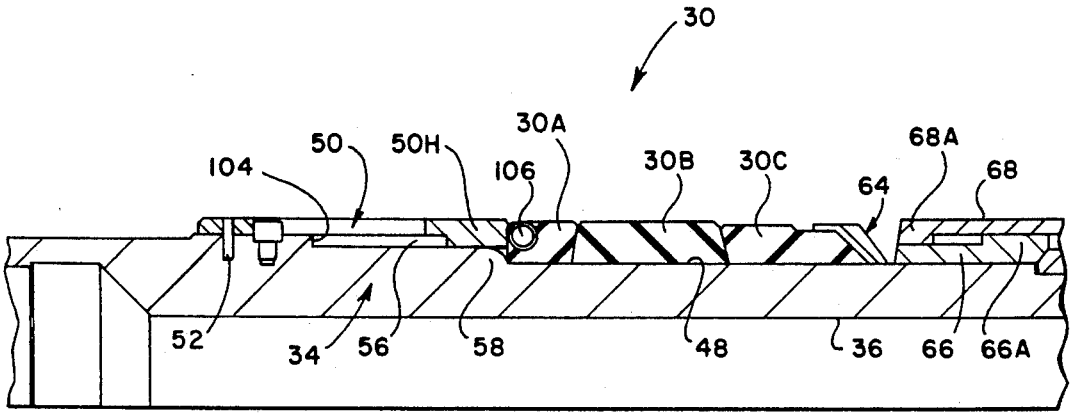
FIG. 7 RUN
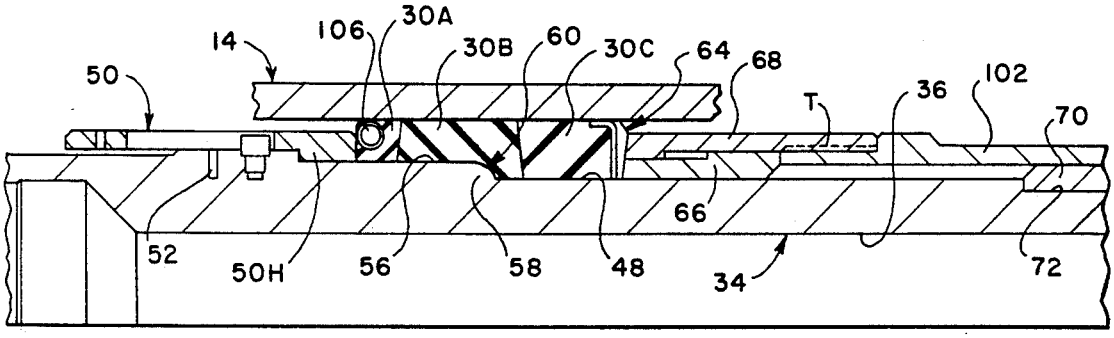
FIG. 8 SET
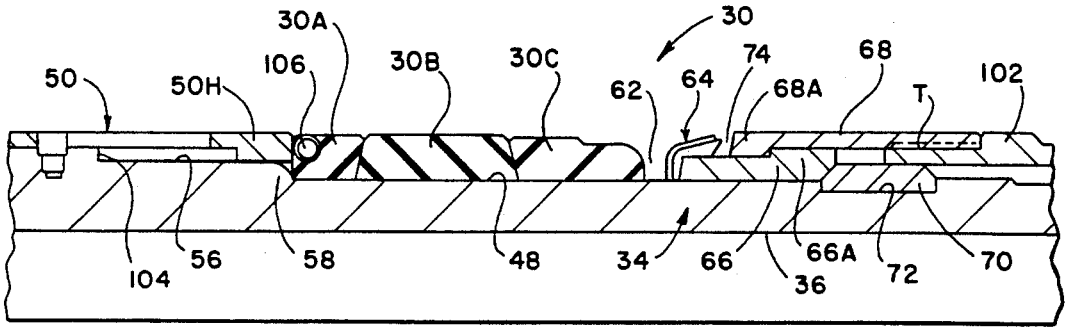
FIG. 9 RELEASE

RETRIEVABLE PACKER FOR HIGH TEMPERATURE, HIGH PRESSURE SERVICE

FIELD OF THE INVENTION

This invention relates to tools and equipment for completing subterranean wells, and in particular to retrievable well packers for releasably sealing the annulus between a tubing string and the bore of the surrounding well casing.

BACKGROUND OF THE INVENTION

In the course of treating and preparing subterranean wells for production, a well packer is run into the well on a work string or a production tubing. The purpose of the packer is to support production tubing and other completion equipment such as a screen adjacent to a producing formation and to seal the annulus between the outside of the production tubing and the inside of the well casing to block movement of fluids through the annulus past the packer location. The packer is provided with anchor slips having opposed camming surfaces which cooperate with complementary opposed wedging surfaces, whereby the anchor slips are radially extendible into gripping engagement against the well casing bore in response to relative axial movement of the wedging surfaces. The packer also carries annular seal elements which are expandable radially into sealing engagement against the bore of the well casing in response to axial compression forces. Longitudinal movement of the packer components which set the anchor slips and the sealing elements may be produced either hydraulically or mechanically.

After the packer has been set and sealed against the well casing bore, it should maintain sealing engagement upon removal of the hydraulic or mechanical setting force. Moreover, it is essential that the packer remain locked in its set and sealed configuration while withstanding hydraulic pressures applied externally or internally from the formation and/or manipulation of the tubing string and service tools without unsetting the packer or interrupting the seal. This is made more difficult in deep wells in which the packer and its components are subjected to high downhole temperatures, for example, as high as 600 degrees F., and high downhole pressures, for example, 5,000 psi. Moreover, the packer should be able to withstand variation of externally applied hydraulic pressures at levels up to as much as 10,000 psi in both directions, and still be retrievable after exposure for long periods, for example, from 10 to 15 years or more. After such long periods of extended service under extreme pressure and temperature conditions, it is desirable that the packer be retrievable from the well by appropriate manipulation of the tubing string to cause the packer to be released and unsealed from the well bore, with the anchor slips and seal elements being retracted sufficiently to avoid seizure against well bore restrictions that are smaller than the retracted seal assembly, for example, at a makeup union, collar union, nipple or the like.

DESCRIPTION OF THE PRIOR ART

Currently, permanent packers are used for long-term placement in high temperature, high pressure wells. Conventional permanent packers are designed in such a way that they become permanently fixed to the casing wall and that helps in the sealing of the element package. However, permanent packers must be milled for removal. One of the major problems involved in removing a permanent packer is that its element package normally has large metal backup rings or shoes that bridge the gap between the packer and the casing and provide a support structure for the seal element to keep it from extruding out into the annulus. The problem with that arrangement is that the large metal backup shoes act like a set of slips and will not release from the casing wall.

Present retrievable high pressure packers use multiple C-ring backup shoes that are difficult to retract when attempting to retrieve the packer. A further limitation on the use of high pressure retrievable packers of conventional design, for example, single slip packers, is that if there is any slack in setting of the packer, or any subsequent movement of the packer, some of the compression force on the element package is relieved. This reduces the total compression force exerted on the seal elements between the mandrel and the casing, therefore permitting a leakage passage to develop across the seal package.

Conventional high pressure retrievable packers utilize backup shoes on the top and bottom seal elements. Consequently, it takes more force to set the seal element package in such a packer because of the drag produced by the metal backup shoes. That is, during set engagement, the slip carrier moves and the seal elements drag against the well casing bore until anchor slip bite against the casing bore is achieved. It will be appreciated that a substantially greater external setting force, either hydraulic or mechanical, will be required to overcome the drag imposed by the metal backup shoes on the top and bottom elements.

The metal backup shoes which prevent extrusion of the seal elements in permanent packers also interfere with retrievability. That is, during compression of the seal elements in a permanent packer, the seal elements are compressed longitudinally, with the compressed seal material filling the annulus between the mandrel and the casing wall and the backup shoes preventing extrusion of the seal elements out of the established compression zone. In such permanent packers, the seal elements are removed by milling, since the seal elements and backup shoes cannot be fully retracted within the drift dimension. Consequently, the radially projecting seal elements drag against the casing bore, and the backup shoes act somewhat like anchor slips as they bite into the well casing.

OBJECTS OF THE INVENTION

The principal object of the present invention is to provide a retrievable packer, either hydraulically set or mechanically set, which will hold up to about 10,000 psi pressure differential in both directions across its seals at elevated temperatures, for example, from about 200 degrees F. to about 400 degrees F., and which will remain retrievable at the end of a long service period, for example, 10–15 years.

A related object of the present invention is to provide a retrievable packer of the character described, which will hold up to about 10,000 psi pressure differential in both directions across its seals at relatively low temperatures, for example, from about 140 degrees F. to about 200 degrees F.

A related object of the present invention is to provide a retrievable packer of the character described which will continue to hold pressure when the well is treated by pumping fluid into it, for example, during fracturing or other forms of stimulation that would result in cooling the packer due to pumping cold fluids through it, with the packer still being able to hold the pressure.

Another object of the present invention is to provide a retrievable packer which can be used reliably under severe well conditions and for long periods of time where permanent packers are presently employed.

Still another object of the present invention is to provide a retrievable packer of the character described in which a reliable seal is maintained between the packer mandrel and the well casing, in spite of any component slack encountered during the setting of the packer, or any subsequent movement of the packer mandrel, for example, because of pressure differential variations, which tend to relieve the compression forces applied to the seal element package in the set position.

Yet another object of the present invention is to provide a retrievable packer of the character described which provides a retraction pocket for receiving the seal element assembly and its backup shoe completely within the outside diameter clearance of the packer without projection into the annulus between the packer and the casing bore.

Still another object of the present invention is to provide a retrievable packer of the character described which includes an improved setting apparatus for centering the seal element assembly within the well casing during the setting operation, thereby providing uniform compression and expansion of the seal elements in the annulus between the packer mandrel and well casing, thus avoiding the formation of uneven extrusion gaps.

Another object of the present invention is to provide a retrievable packer of the character described in which a reliable seal is maintained under high temperature and high pressure conditions for long service periods, where the lower outside element of a seal element assembly is subjected to high differential pressure fluctuations which may cause it to move relative to other seal elements of the assembly.

SUMMARY OF THE INVENTION

The foregoing objects are achieved according to the present invention by a well packer having a tubular body mandrel, an anchor slip assembly, a seal element assembly movably mounted for longitudinal travel along a seal element support surface, and force transmitting apparatus coupled to the anchor slip assembly and to the seal element assembly for radially extending the anchor slip assembly and radially expanding the seal element assembly into set engagement against the internal bore sidewall of a well casing. Improved sealing is provided by prop apparatus disposed on the packer body mandrel which is engagable by the seal element assembly. The prop apparatus has a seal element prop surface which is radially offset with respect to the seal element support surface of the body mandrel. In this split level seal support arrangement, at least one of the seal elements rides on the elevated prop surface and is subjected to a radial squeeze compression force in the set configuration, even though the lowermost outside seal element may be subject to longitudinal separation as a result of internal slack during setting, or as a result of externally applied pressure fluctuations. Moreover, the split level seal element support arrangement provides an annular pocket into which the seal elements are retracted upon release and retrieval of the packer, thereby providing clearance for unobstructed retrieval.

According to another aspect of the present invention, the lower outside seal element is reinforced with a metal backup shoe which defines a radial bridge between the body mandrel and the well casing when the seal element assembly is expanded into engagement against the internal bore sidewall of the well casing. The force transmitting means which applies the setting force to the seal element package include an annular setting sleeve, an element retainer collar, and stop apparatus coupled to the setting sleeve and the retainer collar for limiting extension of the element retainer collar relative to the setting sleeve. According to this arrangement, upon release of the packer, the retainer collar is shifted away from the metal backup shoe, thereby providing an annular pocket into which the metal backup shoe is folded as the packer is retrieved. That is, the metal backup shoe is deflected out of the annulus between the packer and the well casing, and into the receiver pocket so that it does not obstruct the drift clearance as the packer is retrieved.

According to yet another aspect of the present invention, an improved annular garter spring assembly is embedded within the upper outside seal element for preventing extrusion during setting. Additionally, the annular garter spring assembly helps to center the seal assembly for uniform compression and expansion, thereby avoiding the formation of uneven extrusion gaps. In the preferred embodiment, the garter spring assembly includes a helical wound coil which is filled with deformation resistant reinforcing material, for example, a second helical wound coil, spherical balls or elongated pellets.

According to yet another aspect of the present invention, the seal element assembly includes a plurality of longitudinally compressible, radially expandable seal elements, with one of the seal elements being compressed against the seal element support surface of the packer mandrel, and one of the seal elements being compressed against the seal element prop surface when the seal element assembly is expanded into sealing engagement against a well casing. In the preferred embodiment, the seal element assembly includes a central seal element, an upper outside seal element, and a lower outside seal element. The longitudinal dimensions of the seal elements and the prop surface are selected so that the upper outside seal element and central seal element are compressed against the seal element prop surface, and the lower outside seal element is compressed against the seal element support surface of the packer mandrel when the seal element assembly is expanded into sealing engagement against a well casing. According to this arrangement, radial compression of the upper outside seal element and central seal element, which are compressed against the prop surface, will be maintained at all times, even though the lowermost seal element may be subject to separation because of internal slack or externally applied pressure fluctuations. That is, the upper outside seal element which is supported by the prop surface has a constant squeeze force exerted on it at all times regardless of how much force may be exerted on the lowermost outside end element.

According to another aspect of the invention, a cover sleeve is movably mounted on the body mandrel for longitudinal movement from an extended position in which the prop surface is covered by the sleeve, to a retracted position in which the seal element prop surface is uncovered. The cover sleeve is releasably secured by shear pins to the body mandrel at the extended position in which it engages the upper outside seal element. According to this arrangement, the seal element assembly undergoes longitudinal compression by the force transmitting means until a predetermined amount of compression and expansion have been achieved. At that point, the shear pins separate, and the radially offset prop surface is injected under the upper outside seal element and the central seal element. Preloading of the seal element package provided by the cover sleeve supplies the initial radial movement of the seal elements which make it easier to get the elements up onto the prop surface without damaging the elements. A further advantage is that by preloading the seal elements on the packer mandrel, and then moving the elements from the lower O.D. of the packer mandrel to the upper O.D. of the prop, the seal elements are forced to expand into the annulus uniformly and prevents the formation of uneven extrusion gaps.

The novel features of the invention are set forth with particularity in the claims. The invention will best be understood from the following description when read in conjunction with the accompanying drawings.

BRIEF DESCRIPTION OF THE DRAWINGS

FIG. 7 is a longitudinal view in quarter section of a well packer showing the relaxed position of seal elements in the run position;

FIG. 8 is a view similar to FIG. 7 showing the compressed, expanded position of the seal elements in the set position;

FIG. 9 is a view similar to FIG. 7 showing the seal elements in the relaxed, released position;

DETAILED DESCRIPTION OF THE PREFERRED EMBODIMENTS

Figure 1:
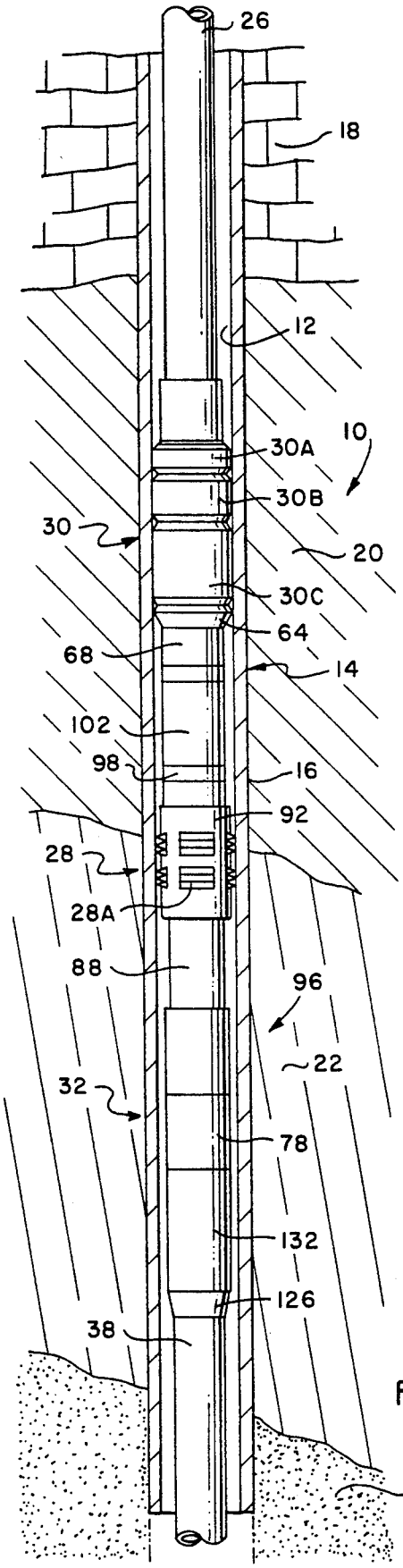
FIG. 1 is a longitudinal view in elevation and section of a retrievable well packer embodying the features of the present invention set in the casing of a well bore providing a releasable seal with the casing wall and a tubing string extending to the packer.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation "S" refers to internal and external O-ring seals and the designation "T" refers to a threaded union.

Referring now to FIG. 1, a well packer 10 is shown in releasably set, sealed engagement against the bore 12 of a well casing 14. The tubular well casing 14 lines a well bore 16 which has been drilled through an oil and gas producing formation, intersecting multiple layers of overburden 18, 20 and 22, and then intersecting a hydrocarbon producing formation 24. The mandrel of the packer 10 is connected to a tubing string 26 leading to a wellhead for conducting produced fluids from the hydrocarbon bearing formation 2 to the surface. The lower end of the casing which intersects the producing formation is perforated to allow well fluids such as oil and ga to flow from the hydrocarbon bearing formation 24 through the casing 14 into the well bore 12.

The packer 10 is releasably set and locked against the casing 14 by an anchor slip assembly 28. A seal element assembly 30 mounted on the packer body mandrel is expanded against the well casing 14 for providing a fluid tight seal between the packer mandrel and the well casing so that formation pressure is held in the well bore below the seal assembly and formation fluids are forced into the bore of the packer to flow to the surface through the production tubing string 26.

The packer 10 is run into the well bore and set by either a mechanical running tool or by hydraulic means. The anchor slips of the anchor slip assembly 28 are first set against the well casing, followed by expansion of the seal element assembly. The packer includes force transmitting apparatus with a ratchet lock assembly which maintains the set condition after the mechanical setting force or hydraulic setting pressure is removed. The packer 10 is readily retrieved from the well bore with the assistance of a retrieving tool and by a straight upward pull which is conducted through the packer mandrel to a release assembly 32 which permits the anchor slip to retract and the seal elements to relax, thus freeing the packer for retrieval to the surface.

Referring now to FIGS. 1-6, the anchor slip assembly 28, the seal element assembly 30 and release assembly 32 are mounted on a tubular body mandrel 34 having a cylindrical bore 36 defining a longitudinal production flow passage. The lower end of the packer body mandrel 34 is releasably coupled to a lower production tubing string 38 by the release assembly 32. The lower tubing string 38 is continued below the packer within the well casing for supporting a sand screen, polished nipple, tail screen and sump packer, for example. The central passage of the packer bore 36 as well as the polished bore, bottom sub bore, polished nipple, sand screen and the like are concentric with and form a continuation of the tubular bore of the upper tubing string 26.

In the preferred embodiment described herein, the packer 10 is set by a hydraulic actuator assembly 40 (FIG. 4) which includes force transmitting assembly 42 for applying setting forces to the anchor slip assembly 28 and seal element assembly 30. The hydraulic actuator assembly 40 is concentrically mounted about and onto the packer mandrel body 34 between the release assembly 32 and the anchor slip assembly 28. The setting forces are coupled to the anchor slip assembly by a lower force transmitting assembly 44 and an upper force transmitting assembly 46.

Figure 2:
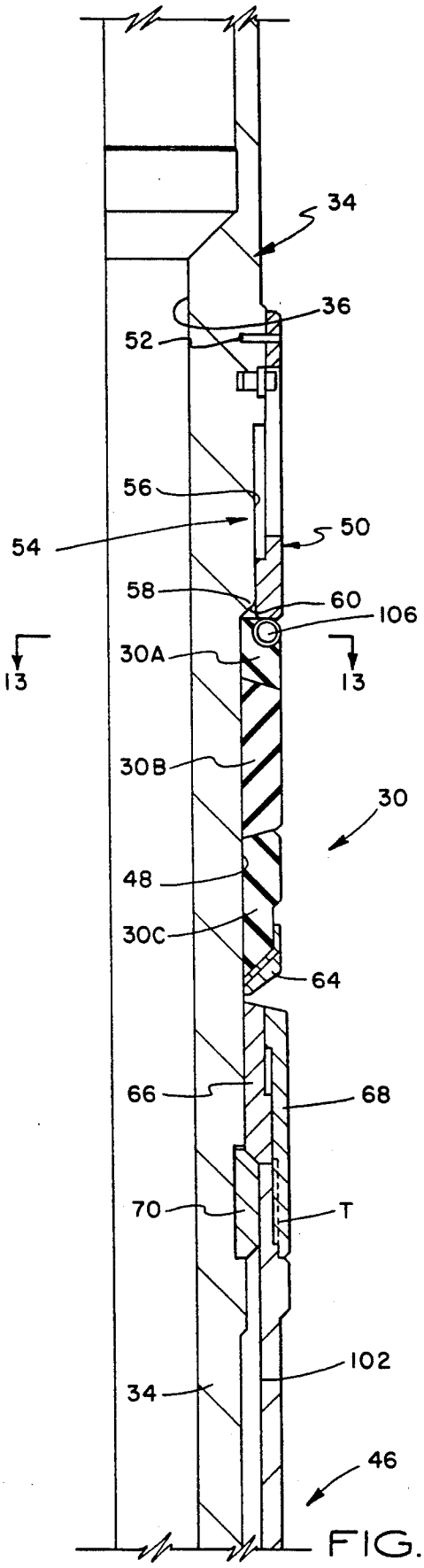
FIGS. 2 through 6, inclusive and taken together, form a longitudinal view in section of the retrievable well packer and seal assembly of the invention showing the seal assembly relaxed and the packer slips retracted as the packer is run into a well bore.

Referring now to FIG. 2, the seal element assembly 30 is mounted directly onto an external support surface 48 of the packer mandrel body 34. The seal element assembly 30 includes an upper outside packing end element 30A, a center packing element 30B and a lower outside packing end element 30C. According to an important feature of the present invention, the upper end seal element 30A is releasably fixed against axial upward movement by engagement against a cover sleeve 50. The cover sleeve 50 is movably mounted on the body mandrel 34 for longitudinal movement from an extended position, as shown in FIG. 2, in which the cover sleeve engages the upper outside seal element 30A, to a retracted position (FIG. 8) which permits the seal element assembly to travel upwardly along the external surface of the packer mandrel body 34. The cover sleeve 50 is releasably secured by one or more shear pins 52 to the body mandrel 34 at the extended position at which it engages the upper outside seal element 30A. In this arrangement, the seal element assembly undergoes longitudinal compression by the upper force transmitting assembly 46 until a predetermined amount of compression and expansion have been achieved.

According to another important feature of the invention, improved sealing engagement is provided by prop apparatus 54 which is mounted on the packer body mandrel 34. In the preferred embodiment, the prop apparatus is a radially stepped shoulder member 54 which is integrally formed with the body mandrel, with the prop surface 56 being radially offset with respect to the seal element support surface 48. In this arrangement, the prop apparatus 54 forms a part of the tubular body mandrel 34. The seal element prop surface 56 is preferably substantially cylindrical, and the seal element support surface is also preferably substantially cylindrical. As can be seen in FIG. 2, the seal element prop surface 56 is substantially concentric with the seal element support surface 48.

As the shear pins separate in response to the application of setting force through the force transmitting assembly 46, the radially offset prop surface 56 is injected under the upper outside seal element 30A and also under the central seal element 30B, substantially as shown in FIG. 8. Preloading of the seal element assembly 30 provided by the cover sleeve 50 supplies the initial radial movement of the seal elements which make it easier to get the elements up onto the prop surface 56 without damaging the elements. Radial deflection and transition movement of the seal elements from the lower O.D. of the packer mandrel surface 48 to the upper O.D. of the prop surface 56 is assisted by an annular ramp member 58 which is disposed intermediate the mandrel 34 and the prop apparatus 54.

The ramp member 58 has an external surface 60 which slopes transversely with respect to the seal element support surface 48 and the seal element prop surface 56. Preferably, the slope angle as measured from the seal element support surface 48 to the external surface 60 of the ramp member 58 is in the range of from about 135 degrees to about 165 degrees. The purpose of the ramp surface is to provide a gradual transition to prevent damage to the upper seal element 30A as it is deflected onto the radially offset prop surface 56.

Figure 22:
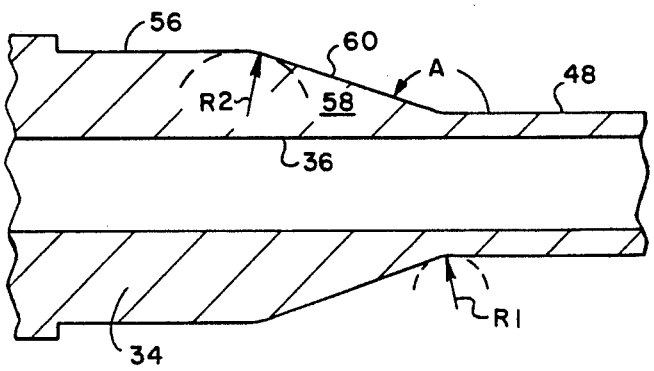

Referring to FIG. 22, a transitional radius R1 is provided between the packer mandrel surface 48 and the sloping ramp surface 60, and a second radius R2 is provided between the ramp surface 60 and the radially offset prop surface 56. The two radius surfaces R1, R2 complement each other so that there is a smooth movement of the upper end element seal 30A from the packer mandrel surface 48 to the radially offset prop surface 56 without damage to the seal element material. For a slope angle A of 135 degrees, a relatively small radius of transition R1 of 0.06 inch radius is provided, and the second, relatively large radius is approximately 0.5 inch radius. According to this arrangement, a gently sloping ramp surface 60 provides an easy transition for the preloaded upper end seal element 30A to be deflected onto the radially offset prop surface 56. As the slope angle is increased, it becomes more important to radius the corners of the transition, and the specific radius values are determined based primarily on the size of the packer.

Referring now to FIGS. 7, 8 and 9, the longitudinal dimensions of the sealing elements 30A, 30B and 30C, and the length of the prop surface 56 are so selected that the upper outside end seal element 30A and the central seal element 30B are compressed against the seal element prop surface 56 and the lower outside seal element 30C is compressed against the body mandrel support surface 48 when the seal element assembly is expanded into sealing engagement against a well casing, as shown in FIG. 8.

In this split level seal support arrangement, at least one of the seal elements, the upper end seal element 30A, is supported on the elevated prop surface 56 and is subjected to a radial squeeze compression force in the set configuration, even though the lowermost outside seal element 30C may be subject to longitudinal separation as a result of internal slack during setting, or as a result of externally applied pressure fluctuations.

Another advantage of the split level seal element support arrangement is that the radially reduced support surface 48 of the packer mandrel provides an annular pocket 62 (FIG. 9) into which the seal elements are retracted upon release and retrieval of the packer. That is, upon release, the seal elements 30A, 30B are pushed off of the prop surface 56 and slide onto the lower mandrel seal support surface 48 within the annular pocket 62. Thus the seal elements are permitted to expand longitudinally through the annular pocket 62, and away from the drift clearance thereby permitting unobstructed retrieval.

As shown in FIG. 2 and FIG. 7, the upper outside seal element 30A has a substantially shorter longitudinal dimension than the central seal element 30B and the lower outside seal element 30C. The longitudinal dimension of the prop surface 56 is selected so that both the upper outside seal element 30A is fully supported and the central seal element 30B is at least partially supported on the radially offset prop surface 56 in the set, expanded position, as shown in FIG. 8. Even though the lower outside seal element 30C and the central seal element 30B may be subjected to longitudinal excursions as a result of pressure fluctuations, the sealing engagement of the upper outside seal element 30A is maintained at all times.

The lower outside seal element is reinforced with a metal backup shoe 64. The metal backup shoe 64 provides a radial bridge between the body mandrel 34 and the well casing 14 when the seal element assembly is expanded into engagement against the internal bore sidewall of the well casing, as shown in FIG. 8. The purpose of the metal backup shoe 64 is to bridge the gap between the packer mandrel and the casing and provide a support structure for the lower outside seal element 30C to prevent it from extruding into the annulus between the packer mandrel and the well casing.

The dimensions of the seal elements and the prop surface O.D. are selected to provide a minimum of 5 percent reduction in radially compressed thickness to a maximum of 30 percent reduction in radially compressed thickness as compared with the lower outside seal element 30C when compressed in the set position, for example as shown in FIG. 8.

The backup shoe 64 is preferably constructed in the form of annular metal discs, with the inside disc being made of brass and the outer metal disc being made of Type 1018 mild steel. Both metal discs are malleable and ductile, which is necessary for a tight conforming fit about the lower edge of the outside end seal element 30C. Additionally, the ductile feature is desired to permit the backup shoe to deflect and fold over as shown in FIG. 9 in the released position.

The force transmitting apparatus 46 which applies the setting force to the seal element package includes a lower element retainer ring 66 mounted for longitudinal sliding movement along the seal element support surface 48 of the packer mandrel 34. An element retainer collar 68 is movably mounted on the external surface of the retainer ring 66 for longitudinal shifting movement from a retracted position (FIG. 7) in which the element retainer collar 68 and retainer ring 66 are engagable against the backup shoe 64, to an extended position longitudinally spaced from the outer backup shoe (FIG. 9) in the released position.

The retainer ring 66 and element retainer collar 68 have mutually engagable shoulder portions 66A, 68A, respectively, for limiting extension of the element retainer collar along the external surface of the retainer ring. A split ring 70 is received within an annular slot 72 which intersects the external surface 48 of the packer mandrel 34. The split ring 70 limits retraction movement of the lower element retainer ring 66, thus indirectly limiting retraction movement of the element retainer collar 68, as shown in FIG. 9.

According to this arrangement, during a release operation, the shoulder 66A of the retainer ring 66 engages the split ring 70 and prevents further retraction movement. The element retainer collar 68 continues moving until its stop shoulder 68A engages the stop shoulder 66A. This opens an annular pocket 74 into which the metal backup shoe 64 is folded (FIG. 9) as the packer is retrieved. Upon release of the packer, the retainer collar 68 is shifted away from the metal backup shoe, thus opening the annular pocket 74. The metal backup shoe 64 is then deflected out of the annulus between the packer and the well casing, and into the receiver pocket 74 so that it will not obstruct the drift clearance as the packer 10 is retrieved.

Figure 3:
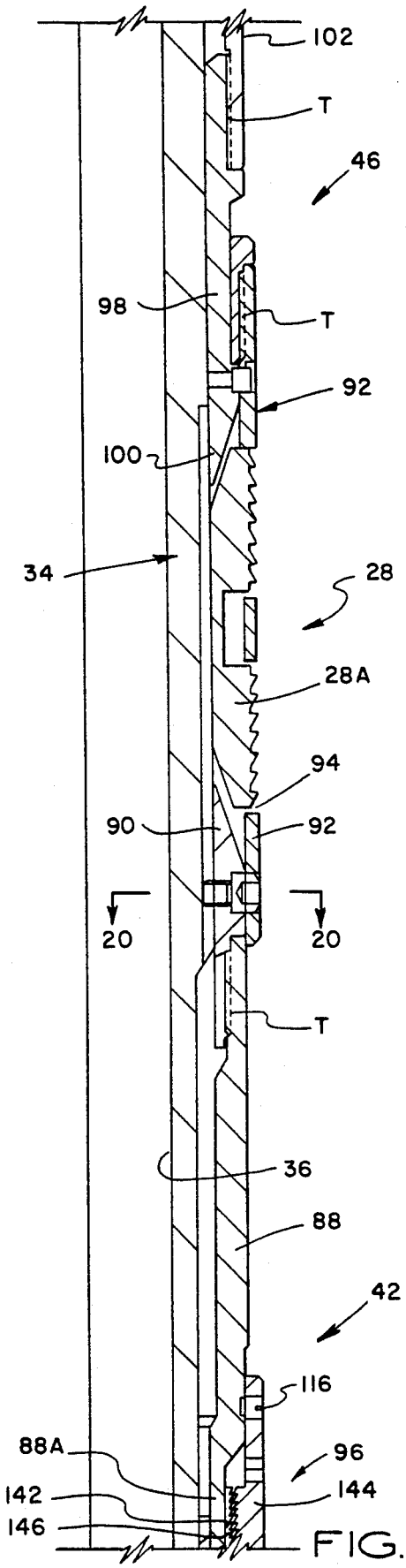
Figure 4:
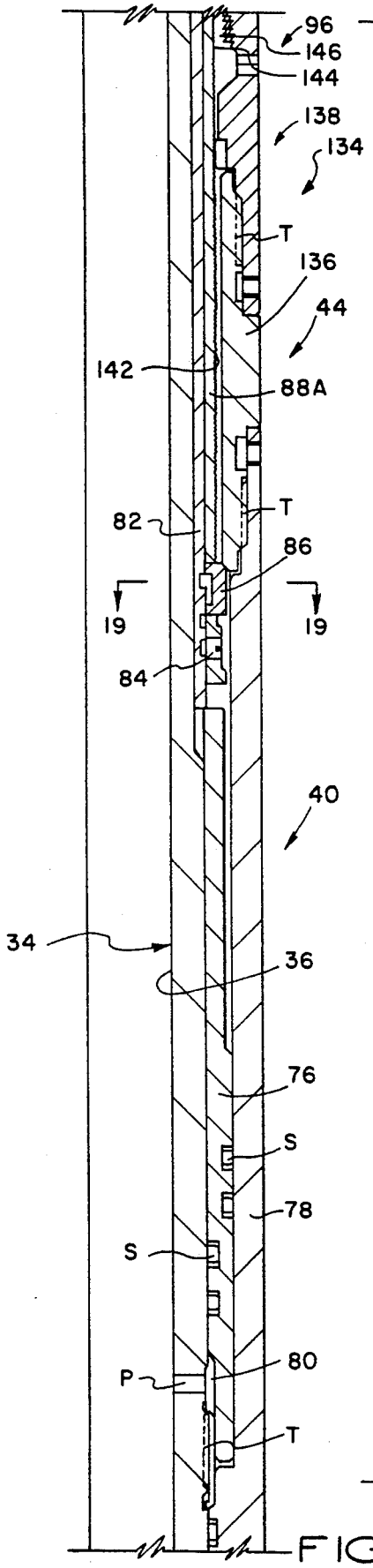
Figure 5:
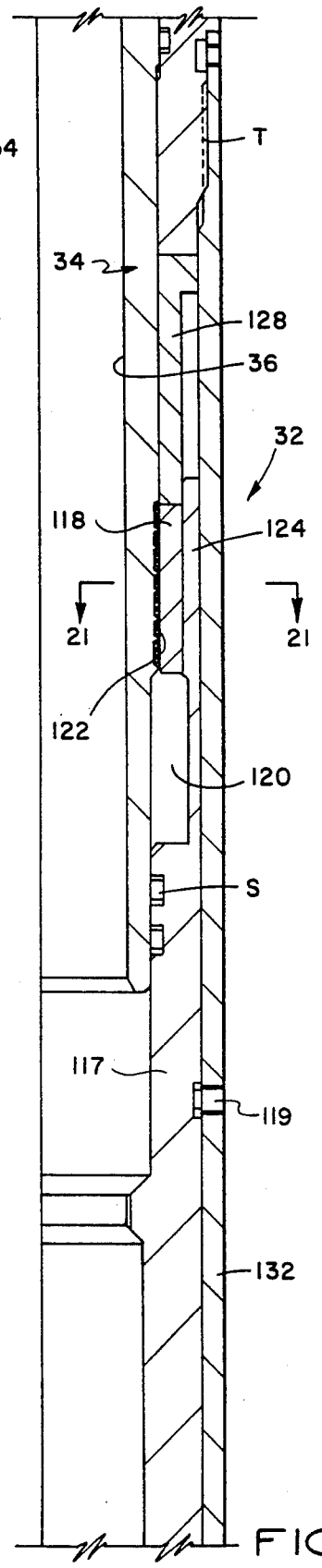
Figure 6:
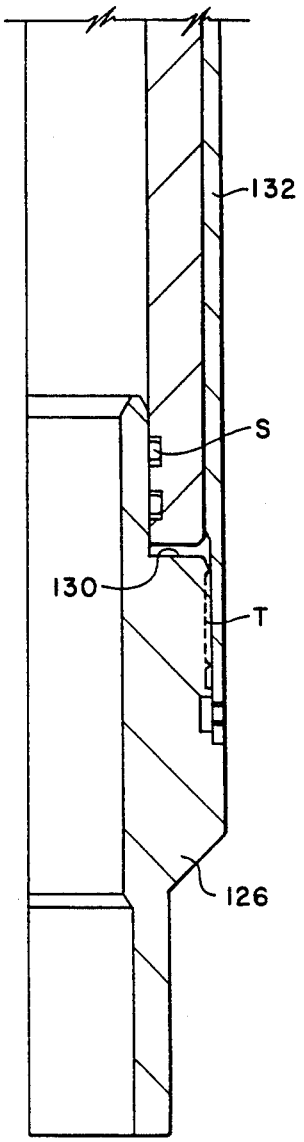

Referring again to FIGS. 2–6, the hydraulic actuator assembly 40 is coupled to the force transmitting assembly 42 for radially extending the anchor slip assembly 28 and seal element assembly 30 into set engagement against the well bore. Referring to FIG. 4, the hydraulic actuator includes a tubular piston 76 which carries annular seals S for sealing engagement against the external surface of the packer mandrel 34. The piston 76 is also slidably sealed against the inside bore of a tubular release sub 78. Hydraulic pressure is applied through an inlet port P which pressurizes an annular chamber 80. As the chamber is pressurized, the piston 76 is driven into engagement with a slip tube 82 which is slidably mounted about the packer body mandrel 34. The slip tube 82 is releasably coupled to the release sub 78 by a shear screw 84 and lock ring 86. A pair of annular slots are formed in the surface of the slip tube 82, and as the shear screw 84 separates, shoulder portions of the lock ring 86 are received within the annular slots, thereby transmitting the setting force to the lower tubular wedge 88.

Referring again to FIG. 3, the lower tubular wedge is connected to a lower spreader cone 90 which is positioned between the packer mandrel external surface and the internal bore of the slip carrier 92. The lower spreader cone 90 is formed in two complementary half sections 90A, 90B.

The slip anchor assembly 28 includes a plurality of slip anchors 28A which are mounted for radial movement through windows 94 formed in the tubular slip carrier 92. While the number of anchor slips 28A may be varied, the tubular slip carrier 92 is provided within an appropriate corresponding number of windows 94, with four anchor slips being preferred. Each of the anchor slips includes upper and lower gripping surfaces positioned to extend radially through the slip carrier windows with the wall of the slip carrier between the paired windows confining a leaf spring which resides in a recess of the anchor slip assembly. The leaf spring biases the anchor slips radially inwardly relative to the wall of the slip carrier 92, thereby maintaining the gripping surfaces retracted in the absence of forces displacing the anchor slips radially outwardly. Each of the gripping surfaces has horizontally oriented gripping edges which provide gripping contact in each direction of longitudinal movement of the packer 10. The gripping surfaces including the horizontal gripping edges, are radially curved to conform with the cylindrical internal surface of the well casing bore against which the slip anchor members are engaged in the set position.

The lower spreader con 90 is positioned between the external packer mandrel surface and the lower bore of the slip carrier and features an upwardly facing frustoconical wedging surface which is generally complementary to the downwardly facing cam surface on the slip member 28A. The lower cone is connected to the tubular wedge 88 by a threaded union T. Retraction movement of the lower tubular wedge 88 is limited by the ratchet coupling 96. In the run in position as illustrated in FIG. 3, the tubular bottom wedge 88 and spreader cone 90 are fully retracted, and are blocked against further downward movement relative to the slip carrier by the stop ring assembly 96.

The slip carrier is releasably coupled to the spreader cone 90 by anti-preset shear screws. According to this arrangement, as the piston 76 is extended in response to pressurization through the port P, the lower wedge 88 and slip carrier, together with the anchor slip assembly is extended upwardly toward the seal element assembly 30. The element retainer collar 68 is coupled to the upper wedge 98 and upper spreader cone 100 by a tubular setting cylinder 102.

As the element retainer collar 68 is driven into engagement with the backup shoe 64, the resilient seal elements 30A, 30B and 30C undergo longitudinal compression until a predetermined amount of radial expansion has been produced. Longitudinal movement of the seal element assembly 30 is opposed by the cover sleeve 50 until the shear pins 52 separate. When a predetermined amount of compression and expansion have been achieved, the shear pins separate and the upper outside seal element is deflected along the sloping surface 60 of the transition member 58 and rides upon the radially offset prop surface 56. The seal element assembly 30 undergoes further compression and expansion as the head 50H of the cover sleeve 50 engages a radially offset shoulder 104 on the packer mandrel.

As the seal elements continue to expand into engagement with the well casing 14, the top portion of the anchor slips will ride up on the upper spreader con and drag against the well casing, thereby causing the anti-preset pins on the slip housing 92 to separate. At that point, the lower spreader cone 90 is driven into engagement with the anchor slips. The anchor slips are then driven radially into gripping engagement with the well casing. Continued pressuring cinches the elements tighter and the set is retained by the segmented C-ring 146.

Figure 10:
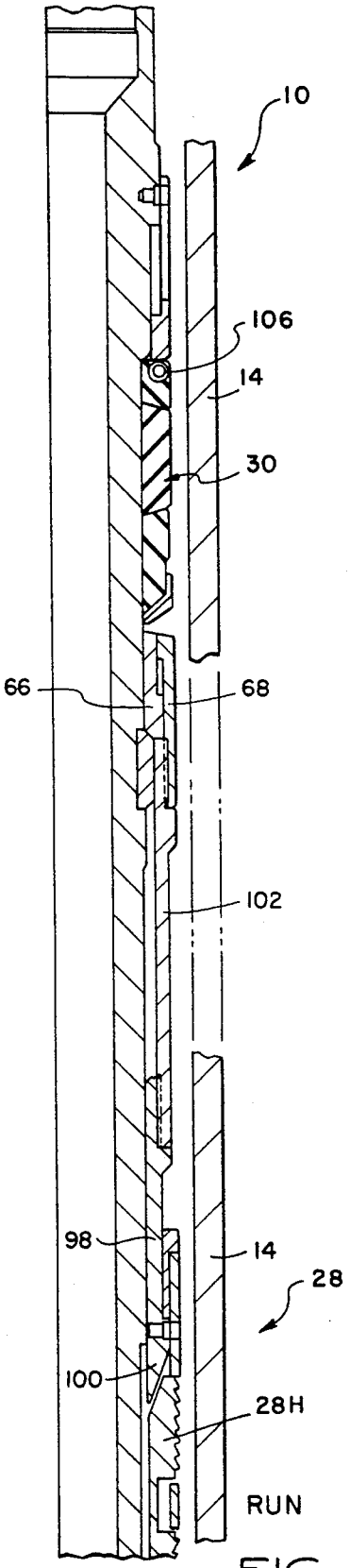
FIG. 10 is a longitudinal view in quarter section of a well packer constructed according to the present invention showing the relationship of the seal elements, force transmitting apparatus and anchor slips in the run position.
Figure 11:
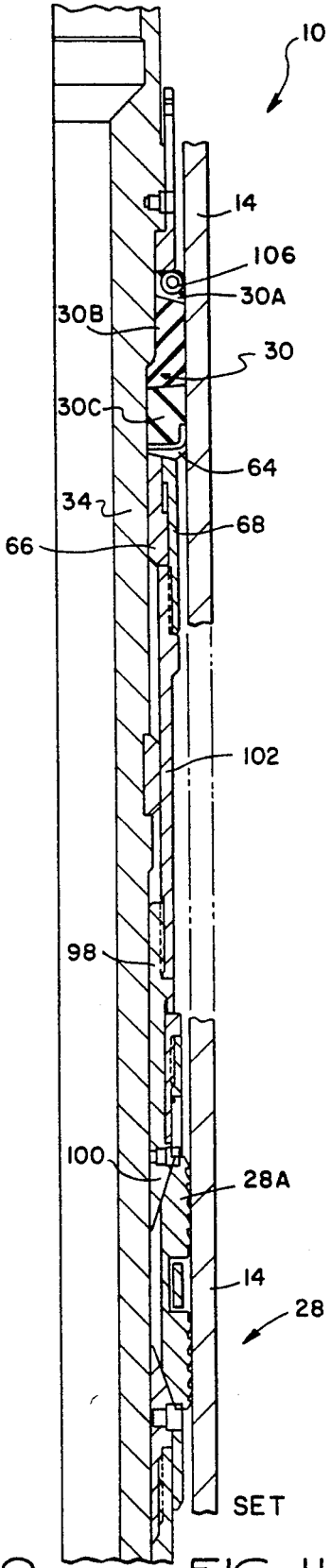
FIG. 11 is a longitudinal view in quarter section, similar to FIG. 10, showing the relative position of the seal elements, force transmitting apparatus and anchor slips in the set position.
Figure 12:
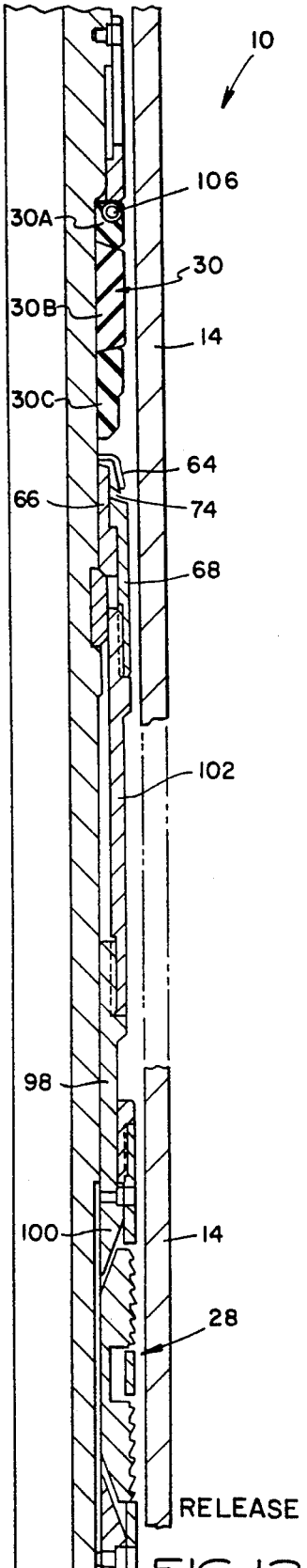
FIG. 12 is a longitudinal view in quarter section of a well packer showing the relative positions of the seal elements, force transmitting apparatus and slip elements in the released position.

The relative positions of the anchor slips and seal elements in the run, set and release positions are indicated in FIGS. 10, 11 and 12, respectively. The radially offset prop surface 56 is protected, and the seal elements 30 are shielded from engagement against obstructing surfaces by the cover sleeve 50 in the run position. The cover sleeve thus protects the seal element package when running into the well bore as the tubing string 26 is manipulated up and down, which is normally carried out while making up and breaking tubing string connections. The cover sleeve 50 also protects the element package, as shown in FIG. 12, when the packer has been released and is being retrieved from the well.

As shown in FIG. 11, the backup shoe 64 bridges the annulus between the packer mandrel 34 and the well casing 14. The primary purpose of the backup shoe 64 is to prevent extrusion of the lower outer seal element 30C into the annulus. The backup shoe 64 is deflected and retracted into the receiver pocket 74 as shown in FIG. 12 as the packer is retrieved. Because of the tendency of the backup shoe to act as an anchor slip, a garter spring assembly 106 is embedded in the upper outside seal element 30A to prevent extrusion into the annulus. The annular garter spring assembly 106 helps to center the seal element assembly 30 for uniform compression and expansion, thereby avoiding the formation of uneven extrusion gaps.

Figure 13:
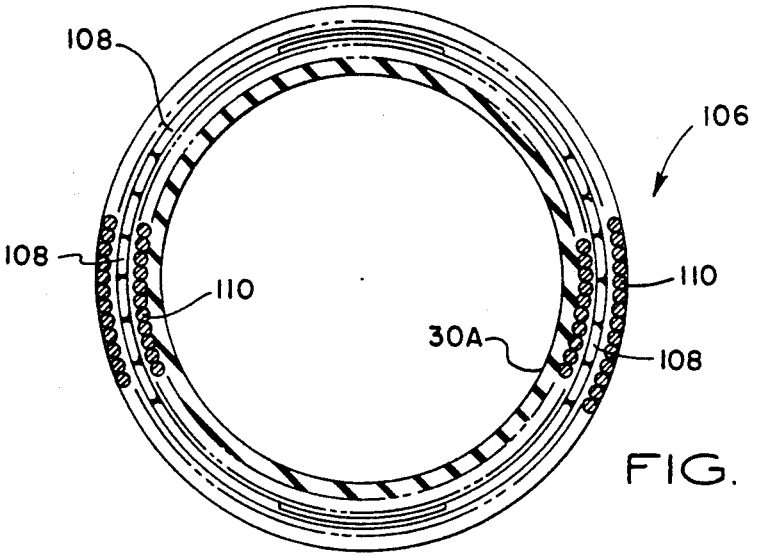
FIG. 13 is a cross section view of the improved seal element of the present invention, taken along the line 13—13 of FIG. 2, showing a single coil of reinforcing wire in the outside upper element, with reinforcement means enclosed within the coil.
Figure 14:
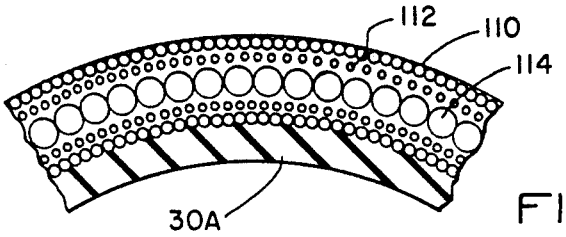
FIG. 14 is a sectional view similar to FIG. 13, and partially broken away, showing spherical reinforcement balls enclosed within the core of a dual reinforcement spring.
Figure 15:
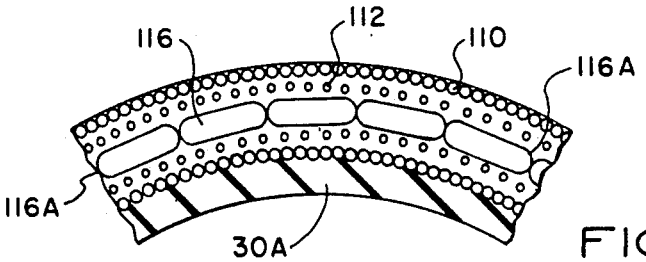
FIG. 15 is a view similar to FIG. 14 in which the deformation resistant reinforcing material is elongated pellets having radiused end portions.
Figure 16:
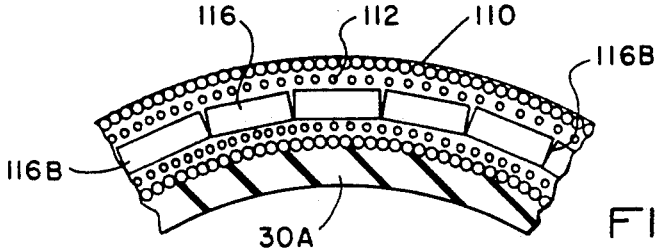
FIG. 16 is a view similar to FIG. 15 in which the elongated pellets have truncated end portions.

To provide reliable service at high differential pressure levels, for example, at 10,000 psi, it was necessary to provide a reinforced garter spring assembly 106 as shown in FIG. 13, and in the alternative embodiments as shown in FIGS. 14, 15 and 16. The failure mode of a non-reinforced end seal element is extrusion of the element past the containment means provided by the packer body. Adding a conventional garter spring, reinforces the seal element and prevents extrusion until the garter spring collapses and moves into the gap. The seal element is then free to extrude into the gap behind the failed portion of the garter spring.

It has been determined that a substantially improved garter spring assembly 106 can be achieved by enclosing a deformation resistant reinforcing material 108 within the garter spring. Referring to FIG. 13, the garter spring is formed by a single metal wire which is wound in a helical coil 110 which is embedded within the seal element 30A near the outside corner. That is, the deformation resistant reinforcing material 108 is completely enclosed within the helical turns of the garter spring coil 110.

According to one effective arrangement, the deformation resistant reinforcing material is enclosed within a second helical wound coil 112, which is enclosed within the outer garter spring coil 110, as shown in FIG. 14. Adding one or more concentric garter springs to the inside of the primary garter spring 110 reinforces the assembly and increases the pressure at which the packer element fails. However, more than two concentric coils are difficult to deploy. The unsupported inside diameter of the smaller garter spring 112 allows the garter spring combination to collapse and failure will occur, but at a proportionally higher pressure.

Further reinforcement is provided, as shown in FIG. 14, by spherical balls 114. According to one alternative embodiment, the deformation resistant reinforcing material is in the form of elongated pellets 116, as shown in FIG. 15. In that embodiment, the pellets 116 preferably have radiused end portions 116A. Yet another reinforcement embodiment is shown in FIG. 16, in which the elongated pellets 116 have truncated end portions 116B. The length of the pellets 116 is preferably in the range of from about 2 to about 3 times the cross sectional diameter of the pellets. Preferably, the cross sectional diameter of the pellets 116 and the balls 114 is slightly less than the inside diameter of the innermost garter spring 112.

The reinforcing material 108, whether it be in the form of the spherical balls 114 or the pellets 116, is preferably constructed of a deformation resistant material such as poly-ether keytone polymer, ceramic or a metal such as tungsten carbide.

Referring to FIGS. 2, 3, 4, 5 and 6, the seal assembly 30 is removed with the tubing string prior to releasing the packer. A retrieving tool is attached to the work string and run to depth. The retrieving tool is latched into the latch profile located on the upper end of the packer 10. Upward pull on the retrieving tool causes lugs on the retrieving tool to engage a shifting sleeve 117 in the packer. Further upward pull shears the shear screws 119 on the shifting sleeve 117 allowing the release sleeve to move up aligning the recess 120 in the shifting sleeve 117 with the lock ring 118. The lock ring 118 is then free to disengage the mandrel 34. Continued upward pull shears screws in the retrieving tool allowing the dogs to retract. Continued upward pull is transferred to the packer through the packer mandrel 34. The upper split ring 70 shoulders on the retainer ring 66. Its shoulder 66A shoulders on the retainer shoulder 68A

(FIG. 9), thereby opening the pocket 74 for the shoe 64 to retract. Continued upward pull draws the upper wedge 98 out from under the top portion of the slip 28H. The upper wedge picks up the slip carrier 92. The slip carrier 92 then pulls the slip from the lower wedge 90.

Pressure loading is applied to the tubular column presented by the lower tubular wedge 88 when pressuring from below. To prevent buckling collapse of the lower tubular wedge 88, it is desirable to provide radial support along its length. This is accomplished by a split support assembly 134 consisting of the slip tube 82, a split support ring 136, which is split into three segments, and an internal slip assembly 138. The lower tubular wedge 88 has a tubular, reduced diameter extension 88A which rides on a tubular slip tube 82, which is concentrically mounted on the packer mandrel 34. The column loading is relieved by the support assembly 134, with the load forces being conducted through the split ring assembly 136 through the release sub 78, through a threaded union T to the cylindrical housing 132 to the bottom connector sub 126. The lower tubular wedge extension 88A has helical threads 142 which bear against helical threads 144 carried by a C-ring 146. The C-ring 146 has ratchet threads which mate with ratchet threads formed on the inside bore of the tubular wedge extension 88A.

Figure 17:
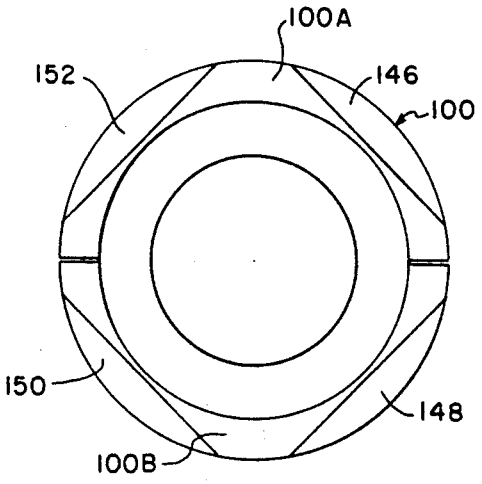
FIG. 17 is an elevational view of the top wedge removed from the packer mandrel.
Figure 18:
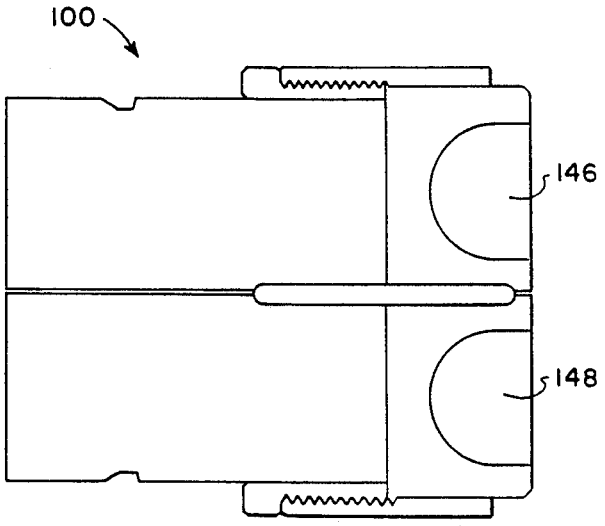
FIG. 18 is a top plan view of the top wedge removed from the packer mandrel.
Figure 19:
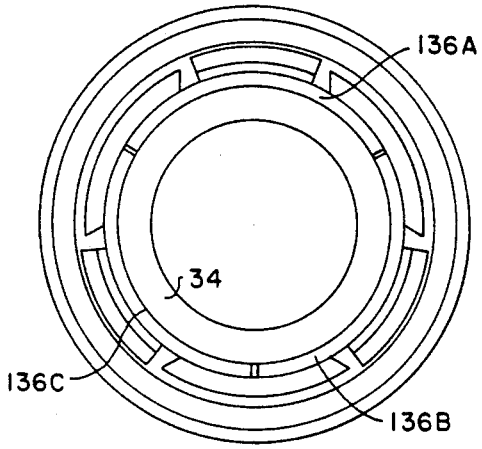
FIG. 19 is a sectional view of a segmented lock ring assembly taken along the lines 19—19 of FIG. 4.
Figure 20:
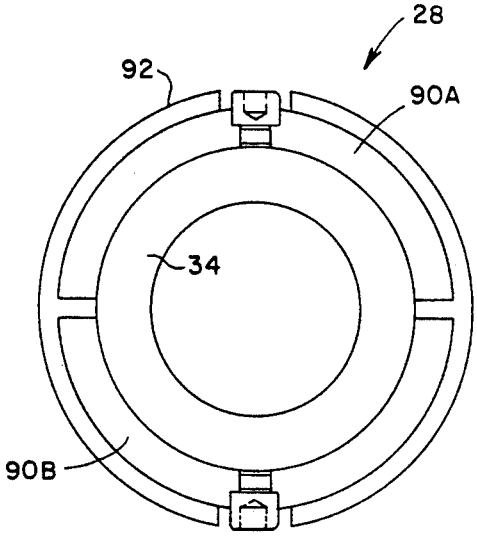
FIG. 20 is a sectional view of the slip carrier and lower wedge assembly taken along the line 20—20 of FIG. 3.
Figure 21:
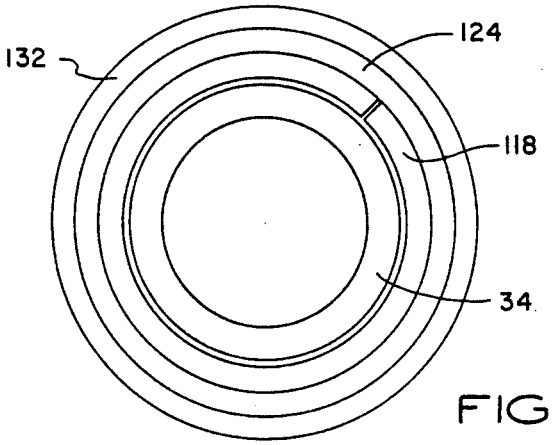
FIG. 21 is a sectional view of a releasable lock ring assembly taken along the line 21—21 of FIG. 5; and, FIG. 22 is a sectional view, partially broken away, which illustrates the radially stepped seal element support surfaces of the present invention.

The load carrying capability of the anchor slips 28A is increased by increasing the cross sectional area of engagement between the slips and the upper spreader cone 100. Referring to FIG. 17 and FIG. 18, this is carried out by flat surfaces 146, 148, 150 and 152 which are machined externally on the spreader cone. That is, the load forces are transmitted to the slips across the flat surfaces and onto the sloping face of the anchor slips rather than on the conical diameter of the slip and cone. If contact was on the conical diameter of the slip and cone as found in conventional packers, the load forces would be transmitted by contact of the slips against the cone. Full force transmitting contact is provided by such conventional packers only at one diameter. However, by transmitting the forces through the flats on the surface of the cone and mating flats on the slips, the contact area is substantially increased. Moreover, in addition to providing increased load capability, the flats also improve the centralizing capability.

While certain preferred embodiments of the invention have been set forth for purposes of disclosure, modification of the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. In a well packer having a tubular body mandrel, an anchor slip assembly, a seal element assembly including an expandable seal element movably mounted for longitudinal travel along a seal element support surface of said body mandrel, and force transmitting apparatus coupled to said anchor slip assembly and said seal element assembly for radially extending said anchor slip element assembly and radially expanding said seal element assembly into set engagement against the internal sidewall bore of a well casing, the improvement comprising:

prop apparatus disposed on said body mandrel and having a tubular seal element prop member radially engagable by said seal element assembly, the seal element prop member having a prop surface which is radially offset with respect to the seal element support surface of said body mandrel; and, the unexpanded radial thickness of the expandable seal element being greater than the radial spacing between the seal element prop surface and the internal sidewall bore of the well casing, but less than the radial spacing between the seal element support surface and the internal sidewall bore of the well casing.

2. A well packer as defined in claim 1, wherein said prop apparatus comprises a radially stepped shoulder member which is integrally formed with said body mandrel, said prop surface being defined by the external surface of said shoulder member.

3. A well packer as defined in claim 1, including a ramp member disposed on said body mandrel intermediate said mandrel and said prop apparatus, said ramp member having an external surface which slopes transversely with respect to said seal element support surface and said seal element prop surface;

the slope of the ramp surface relative to the seal element support surface being in the range of from about 135 degrees to about 165 degrees.

4. A well packer assembly as defined in claim 1, wherein said seal element assembly comprises first, second and third longitudinally compressible, radially expandable seal elements, and wherein the longitudinal dimensions of said sealing elements and said prop surface are so selected that the first and second seal elements are radially compressed against said seal element prop surface and the third seal element is radially compressed against said seal element support surface when said seal element assembly is expanded into sealing engagement against a well casing.

5. A well packer assembly as defined in claim 1, including a cover sleeve movably mounted on said body mandrel for longitudinal movement from an extended position in which said prop surface is covered by said sleeve, to a retracted position in which the seal element prop surface is uncovered;

at least one shear pin releasably securing said cover sleeve to said body mandrel at said extended position;

stop means disposed on said body mandrel adjacent said prop surface, said cover sleeve being engagable against said stop means at the limit of its travel to the retracted position;

said cover sleeve having a tubular sidewall and an annular head radially offset from said sidewall, said annular head being disposed in slidable engagement with said seal element prop surface, and said cover sleeve head being engagable against said stop means when said sleeve is moved to the retracted position; and, the tubular sidewall of said cover sleeve being intersected by a longitudinal slot, and including a radially projecting guide lug mounted on said body mandrel, said guide lug being received within said slot.

6. A well packer as defined in claim 1, said seal element assembly including an outside seal element and an annular backup shoe mounted on said outside seal element, said backup shoe defining a radial bridge between said body mandrel and a well casing when said seal element assembly is expanded into engagement against the internal bore sidewall of the well casing; and, said force transmitting means including a lower element retainer ring slidably mounted for longitudinal movement along said body mandrel; an upper element retainer collar movably mounted on said retainer ring for longitudinal movement from a first position in which said element retainer collar and retainer ring are engagable against said backup shoe, to second position in which the element retainer collar is longitudinally spaced from said backup shoe and is longitudinally shifted with respect to the retainer ring thereby defining an annular pocket for receiving a folded backup shoe; stop apparatus mounted on said body mandrel for limiting retraction movement of said retainer ring relative to said body mandrel; and, said retainer ring and said element retainer collar having mutually coacting stop members for limiting extension of said element retainer collar relative to said retainer ring.

7. A well packer as defined in claim 1, said seal element assembly including an outside seal element and an annular garter spring assembly embedded within said seal element, said garter spring assembly comprising a helical wound coil and multiple segments of deformation resistant reinforcing material disposed within said helical wound coil, said segments being confined therein for end-to-end engagement with each other.

8. A well packer as defined in claim 7, wherein said deformation resistant reinforcing segments comprise spherical balls.

9. A well packer as defined in claim 7, wherein said deformation resistant reinforcing material comprises elongated pellets.

10. A well packer as defined in claim 9, wherein said elongated pellets have radiused end portions.

11. A well packer as defined in claim 9, wherein said elongated pellets have truncated end portions.

12. A well packer as defined in claim 9, wherein the length of said pellets is in the range of from about one and one-half to about three times the cross sectional diameter of said pellets.

13. A well packer as defined in claim 7, wherein said deformation resistant reinforcing segments comprise poly-etherkeytone polymer.

14. A well packer as defined in claim 7, wherein said deformation resistant reinforcing segments comprise ceramic.

15. A well packer as defined in claim 7, wherein said deformation resistant reinforcing segments comprise metal.

16. A well packer as defined in claim 15, wherein said metal comprises tungsten carbide.

17. In a well packer having a tubular body mandrel, an anchor slip assembly, a seal element assembly movably mounted for longitudinal travel along a seal element support surface of said body mandrel, and force transmitting apparatus coupled to said anchor slip assembly and said seal element assembly for radially expanding said seal element assembly into set engagement against the internal bore sidewall of a well casing, the improvement comprising:

a cover sleeve mounted on said body mandrel for longitudinal movement from an extended position in which said seal element support surface is covered by said sleeve, to a retracted position in which the seal element support surface is uncovered;

at least one shear pin releasably securing said cover sleeve to said body mandrel at said extended position;

stop means disposed on said body mandrel adjacent said seal element support surface, said cover sleeve being engagable against said stop means at the limit of its travel to the retracted position;

said cover sleeve having a tubular sidewall and an annular head radially offset from said sidewall, said annular head being disposed in slidable engagement with said seal element support surface, and said cover sleeve head being engagable against said stop means when said sleeve is moved to the retracted position; and, the tubular sidewall of said cover sleeve being intersected by a longitudinal slot, and including a radially projecting guide lug mounted on said body mandrel, said guide lug being received within said slot.

18. In a well packer having a tubular body mandrel, an anchor slip assembly, a seal element assembly movably mounted for longitudinal travel along a seal element support surface of said body mandrel, and force transmitting apparatus coupled to said anchor slip assembly and said seal element assembly for radially expanding said seal element assembly into set engagement against the internal bore sidewall of a well casing, the improvement comprising:

an annular backup shoe mounted on said body mandrel adjacent said seal element assembly, said backup shoe defining a radial bridge between said body mandrel and a well casing when said seal element assembly is expanded into engagement against the internal bore sidewall of the well casing;

a seal element retainer ring slidably mounted for longitudinal movement along said body mandrel; a seal element retainer collar movably mounted on said retainer ring for longitudinal movement from a first position in which said seal element retainer collar and retainer ring are engagable against said backup shoe, to a sealed position in which the element retainer collar is longitudinally spaced from said outer backup shoe and is longitudinally shifted with respect to the retainer ring thereby defining an annular pocket for receiving a folded backup shoe;

stop apparatus mounted on said body mandrel for limiting retraction movement of said retainer ring relative to said seal element assembly; and, said retainer ring and said retainer collar having mutually engagable stop members for limiting extension of said element retainer collar relative to said retainer ring.

19. In a well packer having a tubular body mandrel, an anchor slip assembly, a seal element assembly movably mounted for longitudinal travel along a seal element support surface of said body mandrel, and force transmitting apparatus coupled to said anchor slip assembly and said seal element assembly for radially extending said anchor slip element assembly and radially expanding said seal element assembly into set engagement against the internal bore sidewall of a well casing, the improvement comprising:

prop apparatus disposed on said body mandrel and engagable by said seal element assembly, said prop apparatus having a seal element prop surface which is radially offset with respect to the seal element support surface of said body mandrel; said seal element assembly including first and second longitudinally compressible, radially expandable outside seal elements, and a third seal element disposed intermediate the first and second outside seal elements, and wherein the longitudinal dimensions of said sealing elements and said prop surface are so selected that at least the first outside seal element is radially compressed against said seal element prop surface and the second outside seal element is radially compressed against said seal element support surface when said seal element assembly is expanded into sealing engagement against a well casing;

an annular backup shoe mounted on said body mandrel adjacent said seal element assembly, said backup shoe defining a radial bridge between said body mandrel and a well casing when said seal element assembly is expanded into engagement against the internal bore sidewall of the well casing; and, a seal element retainer sleeve slidably mounted for longitudinal movement along said body mandrel; a seal element retainer collar movably mounted on said retainer sleeve for longitudinal movement from a retracted position in which said seal element retainer collar and retainer sleeve are engagable against said backup shoe to an extended position longitudinally spaced from said backup shoe, thereby defining a pocket for receiving said backup shoe as it undergoes deflection during retrieval of said packer.

20. A well packer as defined in claim 19, including:

stop apparatus mounted on said body mandrel for limiting retraction movement of said retainer sleeve relative to said body mandrel; and, said retainer sleeve and said retainer collar having mutually engagable stop members for limiting extension of said element retainer collar relative to said retainer sleeve.

21. In a well packer having a tubular body mandrel, an anchor slip assembly, a seal element assembly movably mounted for longitudinal travel along a seal element support surface of said body mandrel, and force transmitting apparatus coupled to said anchor slip assembly and said seal element assembly for radially extending said anchor slip element assembly and radially expanding said seal element assembly into set engagement against the internal bore sidewall of a well casing, the improvement comprising:

prop apparatus disposed on said body mandrel and engagable by said seal element assembly, said prop apparatus having a seal element prop surface which is radially offset with respect to the seal element support surface of said body mandrel;

said seal element assembly including first and second longitudinally compressible, radially expandable outside seal elements, and a third seal element disposed intermediate the first and second outside seal elements, and wherein the longitudinal dimensions of said sealing elements and said prop surface are so selected that at least the first outside seal element radially is compressed against said seal element prop surface and the second outside seal element is radially compressed against said seal element support surface when said seal element assembly is expanded into sealing engagement against a well casing;

a cover sleeve mounted on said body mandrel for longitudinal movement from an extended position in which said prop surface is covered by said sleeve, to a retracted position in which the seal element prop surface is uncovered;

at least one shear pin releasably securing said cover sleeve to said body mandrel at said extended position;

stop means disposed on said body mandrel adjacent said prop surface, said cover sleeve being engagable against said stop means at the limit of its travel to the retracted position;

said cover sleeve having a tubular sidewall and an annular head radially offset from said sidewall, said annular head being disposed in slidable engagement with said seal element prop surface, and said cover sleeve head being engagable against said stop means when said sleeve is moved to the retracted position;

said body mandrel having an annular shoulder defining said stop means, said annular shoulder projecting radially with respect to said prop surface; and, the tubular sidewall of said cover sleeve being intersected by a longitudinal slot, and including a radially projecting guide lug mounted on said body mandrel, said guide lug being received within said slot.

* * * * *